US010840043B2

(12) United States Patent
Delpozzo et al.

(10) Patent No.: US 10,840,043 B2
(45) Date of Patent: Nov. 17, 2020

(54) ELECTRIC TERMINAL FOR ELECTRIC POLE UNITS

(71) Applicant: ABB Schweiz AG, Baden (CH)

(72) Inventors: Andrea Delpozzo, Torbiato di Adro (IT); Emanuele Morelli, Linarolo (IT); Osvaldo Prestini, Nembro (IT)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/461,184

(22) PCT Filed: Jul. 26, 2017

(86) PCT No.: PCT/EP2017/068854
§ 371 (c)(1),
(2) Date: May 15, 2019

(87) PCT Pub. No.: WO2018/091154
PCT Pub. Date: May 24, 2018

(65) Prior Publication Data

US 2020/0066469 A1 Feb. 27, 2020

(30) Foreign Application Priority Data

Nov. 15, 2016 (EP) ..... 16198880

(51) Int. Cl.
*H01H 33/66* (2006.01)
*H01H 33/662* (2006.01)

(52) U.S. Cl.
CPC .. *H01H 33/6606* (2013.01); *H01H 33/66207* (2013.01); *H01H 2033/6623* (2013.01)

(58) Field of Classification Search
CPC ..... H01H 33/6606; H01H 33/66207; H01H 2033/6623
See application file for complete search history.

(56) References Cited

U.S. PATENT DOCUMENTS

2005/0082260 A1* 4/2005 Martin ..... H01H 33/027 218/118
2008/0053810 A1* 3/2008 Hering ..... H01H 1/5822 200/540

(Continued)

FOREIGN PATENT DOCUMENTS

EP 1496535 A1 1/2005
EP 2278603 A1 1/2011
EP 2312604 A1 4/2011

OTHER PUBLICATIONS

European Patent Office, International Search Report & Written Opinion issued in corresponding Application No. PCT/EP2017/068854, dated Nov. 16, 2017, 13 pp.

(Continued)

*Primary Examiner* — Truc T Nguyen
(74) *Attorney, Agent, or Firm* — Taft Stettinius & Hollister LLP; J. Bruce Schelkopf

(57) ABSTRACT

An electric terminal for an electric pole unit of a switching device, the electric terminal being adapted to be electrically connected to a current breaking unit of the electric pole unit and to an external conductor and being adapted to be inserted in a corresponding shaped port of an insulating housing of the electric pole unit. The electric terminal comprises one or more first coupling surfaces mating with one or more second coupling surfaces of the insulating housing, the first coupling surfaces abutting against the second coupling surfaces when the electric terminal is inserted in the corresponding shaped port of the insulating housing in such a way to obtain a mechanical coupling by friction between the electric terminal and the insulating housing.

20 Claims, 11 Drawing Sheets

(56) References Cited

U.S. PATENT DOCUMENTS

| | | | | |
|---|---|---|---|---|
| 2011/0189887 | A1* | 8/2011 | Borgstrom | H01R 3/00 439/488 |
| 2015/0041437 | A1* | 2/2015 | Chapelle | H01H 33/66207 218/139 |
| 2015/0357136 | A1* | 12/2015 | Chen | H01H 33/664 218/123 |
| 2016/0301168 | A1 | 10/2016 | Shi et al. | |

OTHER PUBLICATIONS

European Patent Office, Extended Search Report issued in corresponding Application No. 16198880.3, dated May 4, 2017, 8 pp.

* cited by examiner

ELECTRIC TERMINAL FOR ELECTRIC POLE UNITS

The present invention relates to the field of medium voltage (MV) switching devices, such as circuit breakers, contactors, disconnectors and the like.

For the purposes of the present application, the term "medium voltage" is referred to apparatuses operating at voltages higher than 1 kV AC and 1.5 kV DC up to some tens of kV, e.g. up to 72 kV AC and 100 kV DC.

More particularly, the present invention relates to an electric terminal for an electric pole unit adapted to be arranged in a MV switching device.

As is known, electric pole units of medium voltage switching devices may be of embedded type or assembled type.

In electric pole units of embedded type, the electric terminals (pole terminals) for electric connection with external conductors and the interruption unit are at least partially made in one piece and co-molded with the insulating housing.

In electric pole units of assembled type, the pole terminals and the interruption unit are mechanically connected one to another and to the insulating housing by means of screws or equivalent fastening means.

Electric pole units of assembled type are generally cheaper to manufacture at industrial level with respect to those of embedded type.

However, assembling time of these pole units is relatively long due to the use of a huge number of fasteners (screws, bolts or the like) in order to operatively connect the components or parts of the pole unit.

Further, the use of fasteners coupled or passing through the insulating housing of the pole unit makes it more difficult to ensure proper dielectric distances among the internal components of the pole unit for electric insulation purposes.

Finally, the presence of fixing points for said fasteners weaken the overall structure of the pole unit from a mechanical point of view, thereby decreasing its resistance to mechanical stresses and vibrations.

In the state of the art, it is thus quite felt the need for technical solutions capable of providing electric pole units of assembled type having a reduced number of fasteners (screws, bolts or the like) and with improved performances in terms of electric insulation and resistance to mechanical stresses and vibrations.

In order to respond to this need, the present invention provides an electric terminal for an electric pole unit of a MV switching device, according to the following claim 1 and related dependent claims.

Characteristics and advantages of the invention will emerge from the description of preferred, but not exclusive, embodiments, non-limiting examples of which are provided in the attached drawings, wherein.

Figure 1:
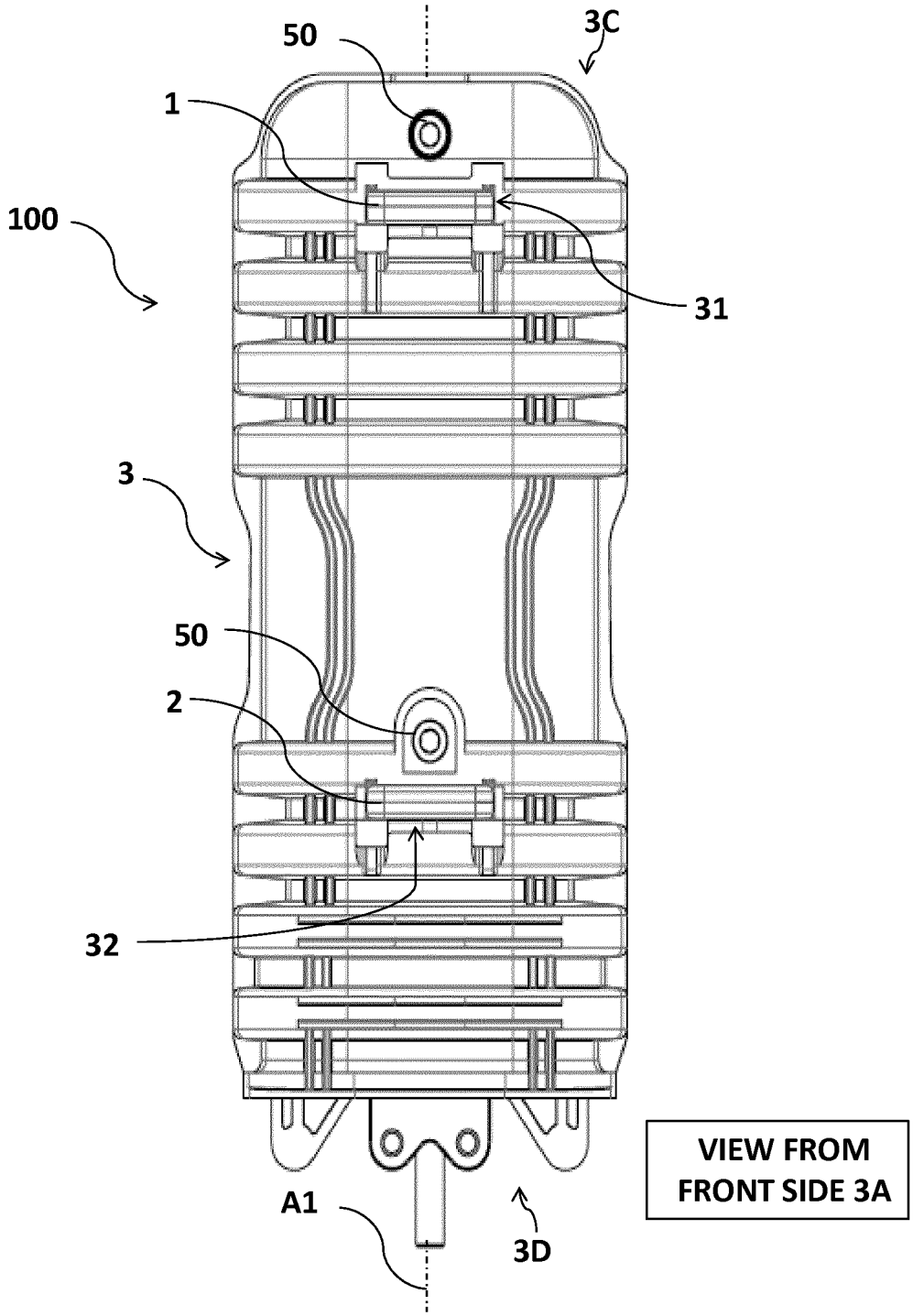
FIGS. 1-6 show schematic views of an electric pole unit incorporating a pair electric terminals, according to the invention.
Figure 2:
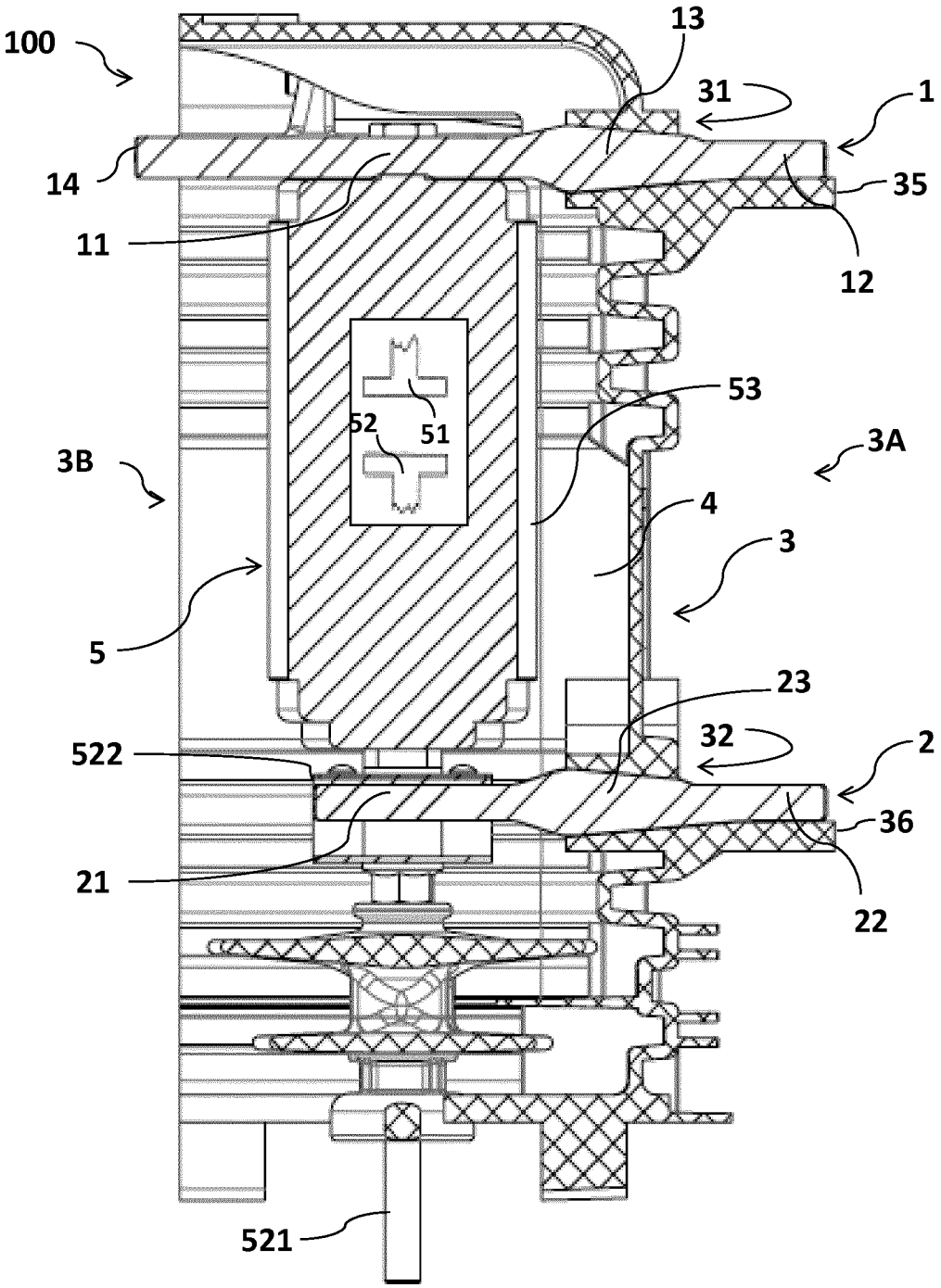
Figure 3:
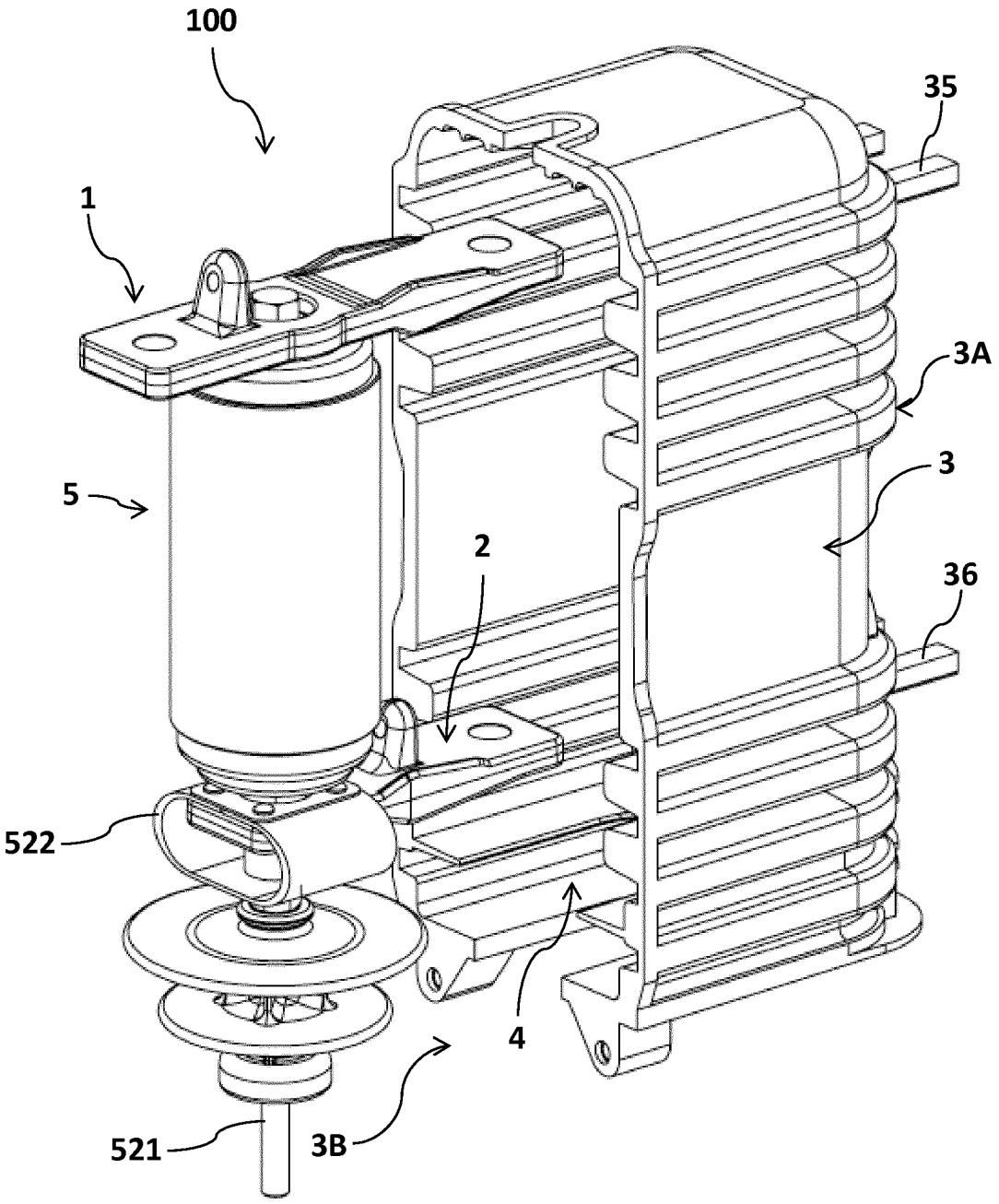
Figure 4:
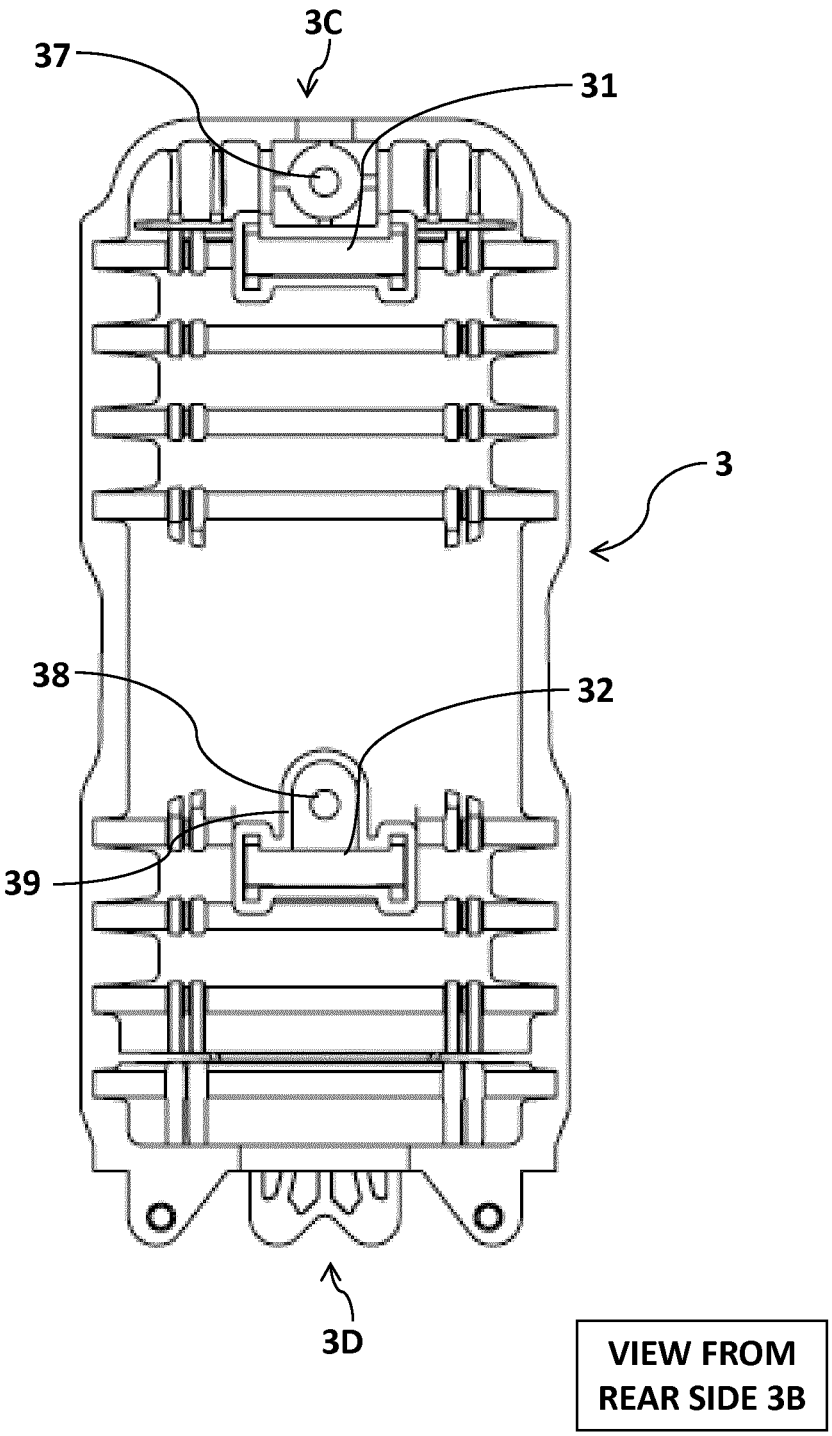
Figure 5:
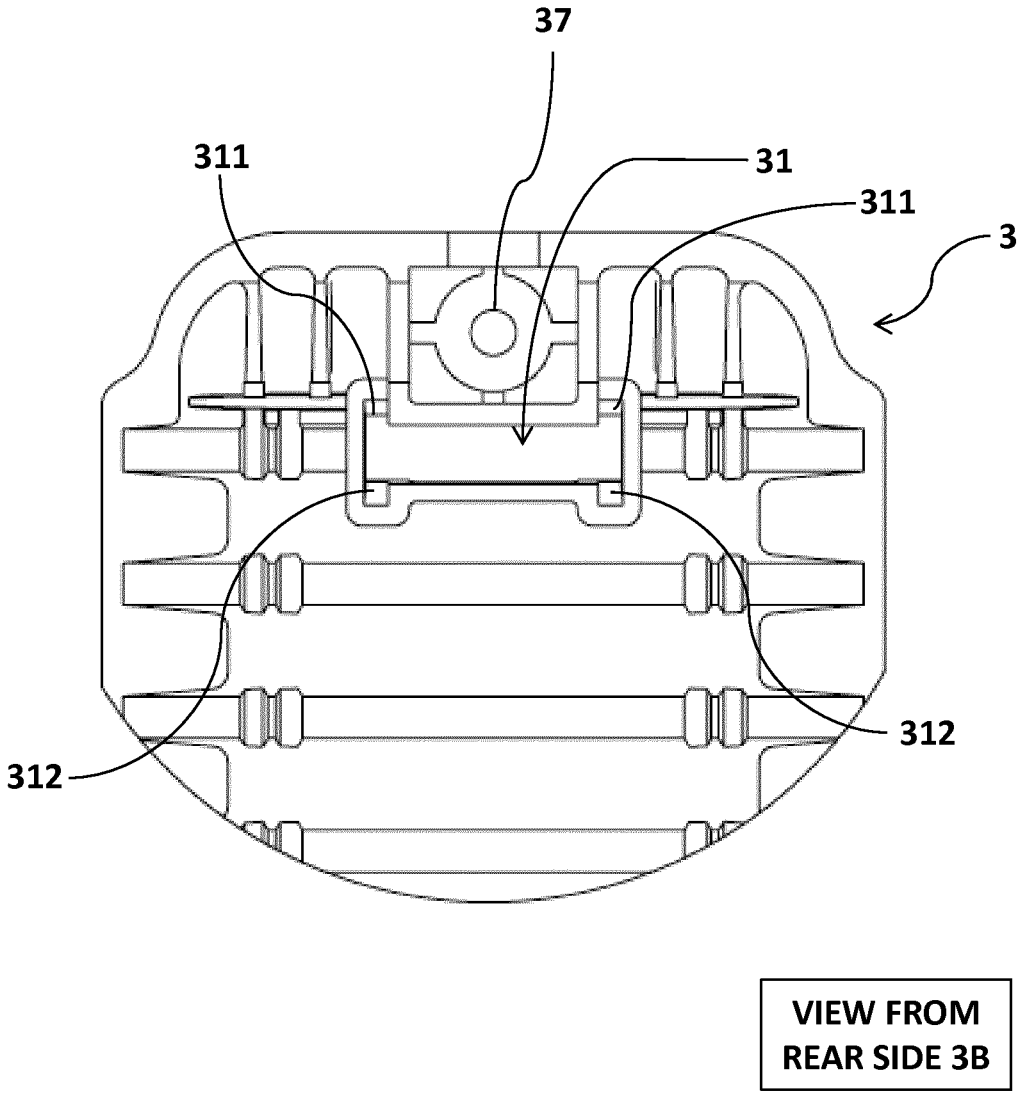
Figure 6:
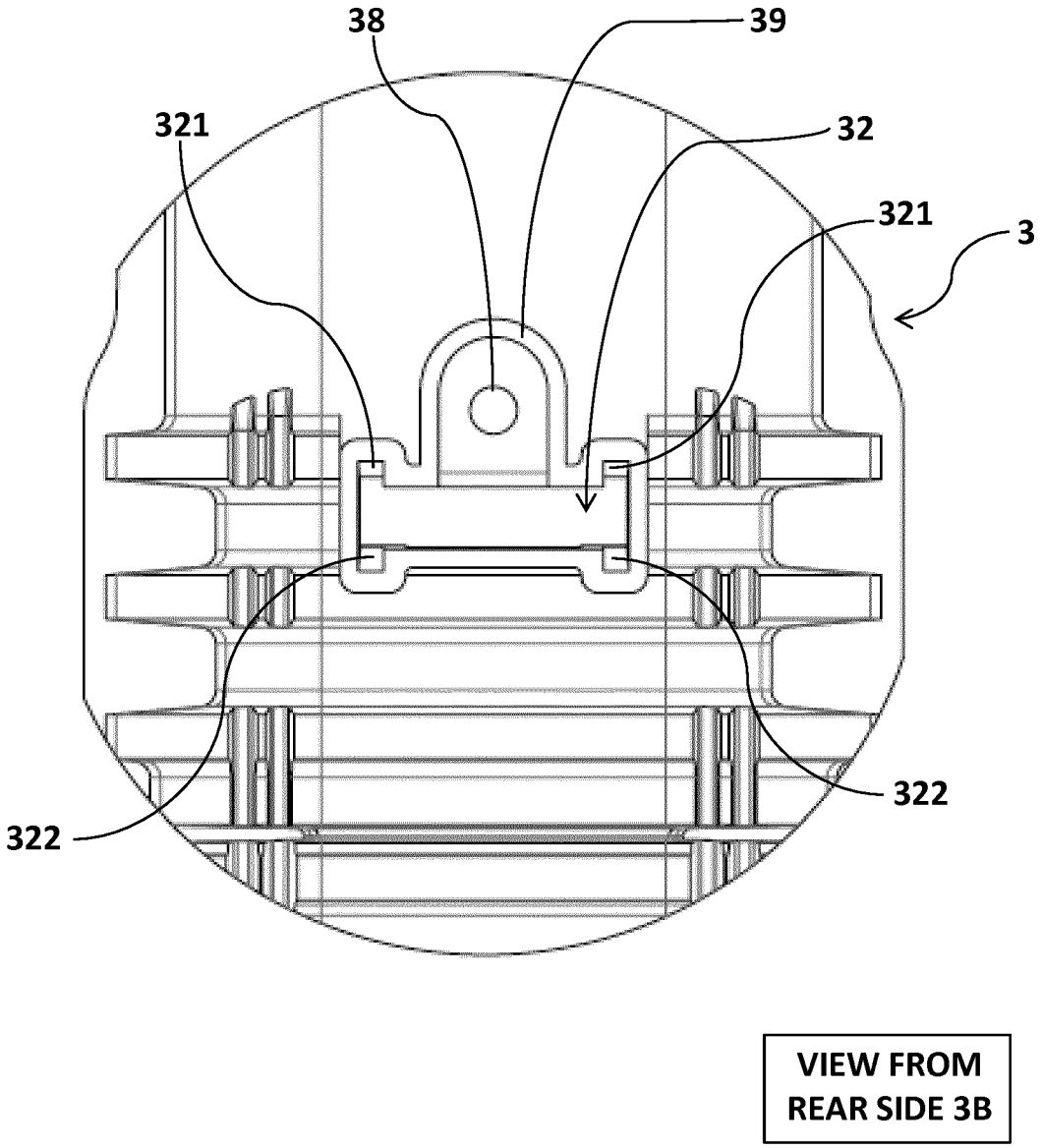

Referring to the cited figures, the present invention relates to electric terminal 1, 2 for an electric pole unit 100 of a MV switching device (not shown), e.g. a circuit breaker, a contactor, disconnector and the like.

Conveniently, as it will be better illustrated in the following, the electric pole unit 100 comprises an insulating housing 3 defining an internal volume 4, in which a current breaking unit 5 is accommodated.

In operation, the electric terminal 1, 2 is electrically connected to a current breaking unit 5 of the electric pole unit 100 and to an external conductor (not shown) and is inserted through a corresponding shaped port 31, 32 of the insulating housing 3.

Conveniently, the electric terminal 1, 2 is formed by an electrically conductive body shaped as an elongated plate having rounded edges.

With reference to its normal installation position shown in the cited figures, the electric terminal 1, 2 has an upper surface 10A, 20A and a lower surface 10B, 20B, which are opposite one to another, opposite sides 10E, 20E, 10F, 20F and opposite ends 10C, 20C, 10D, 20D.

According to the invention, the electric terminal 1, 2 has one or more first coupling surfaces 131A, 132A, 231A, 232A mating with one or more second coupling surfaces 311, 312, 321, 322 of the insulating housing 3.

The first coupling surfaces 131A, 132A, 231A, 232A of the electric terminal 1, 2 abut against the second coupling surfaces 311, 312, 321, 322 of the insulating housing 3 when said electric terminal is inserted in the corresponding shaped port 31, 32 of said insulating housing, in such a way to obtain a mechanical coupling by friction between said electric terminal and said insulating housing.

In other words, according to the invention, the first coupling surfaces 131A, 132A, 231A, 232A of the electric terminal 1, 2 and the second coupling surfaces 311, 312, 321, 322 of the insulating housing 3 are arranged in such a way that they mechanically couple by friction (mechanical shape coupling), when said electric terminal is inserted in the corresponding shaped port 31, 32 of said insulating housing.

Preferably, the first coupling surfaces 131A, 132A, 231A, 232A of the electric terminal 1, 2 and the second coupling surfaces 311, 312, 321, 322 of the insulating housing 3 have mating dovetail or conical profiles.

Preferably, the second coupling surfaces 311, 312, 321, 322 of the insulating housing 3 define at least partially the corresponding shaped port 31, 32 of said insulating housing, in which the electric terminal is adapted to be inserted in operation.

Preferably, the electric terminal 1, 2 comprises a first portion 11, 21 for electrical connection with an external conductor (not shown).

Preferably, the first portion 11, 21 is arranged in such a way to protrude from the insulating housing 3 at a front side 3A of this latter, when, in operation, the electric terminal 1, 2 is inserted in the corresponding shaped port 31, 32 of said insulating housing.

To this aim, the first portion 11, 21 is preferably arranged at a first end 10C, 20C of the electric terminal 1, 2.

Preferably, the first portion 11, 21 comprises a corresponding shaped through hole 110, 210 for accommodating suitable fixing means (e.g. a bolt) for mechanically and electrically connecting the mentioned external conductor to the electric terminal 1, 2.

Preferably, the insulating housing 3 comprises shaped support portions 35, 36 at its front side 3A to provide mechanical support to the first portion 11, 21, when this latter protrudes from said insulating housing.

According to the invention, the electric terminal 1, 2 comprises a second portion 12, 22 for electrical connection with the current breaking unit 5 of the electric pole unit 100.

Preferably, the second portion 12, 22 is arranged in such a way to be accommodated in the internal volume 4 of the insulating housing, when the electric terminal 1, 2 is inserted in the corresponding shaped port 31, 32 of said insulating housing.

Preferably, the second portion 12, 22 comprises a corresponding shaped through hole 120, 220.

Figure 7:
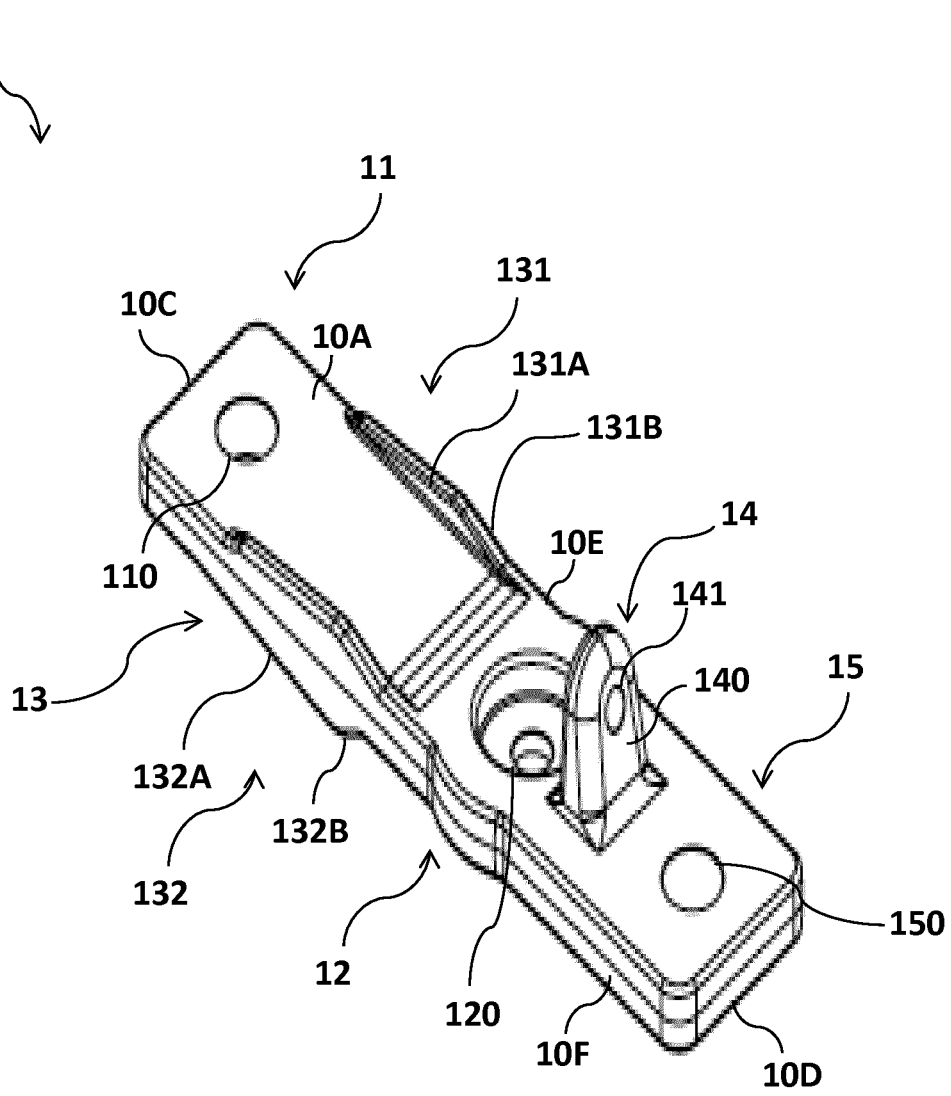
FIG. 7-9 shows schematic views of an electric terminal, according to the invention, in an embodiment.
Figure 8:
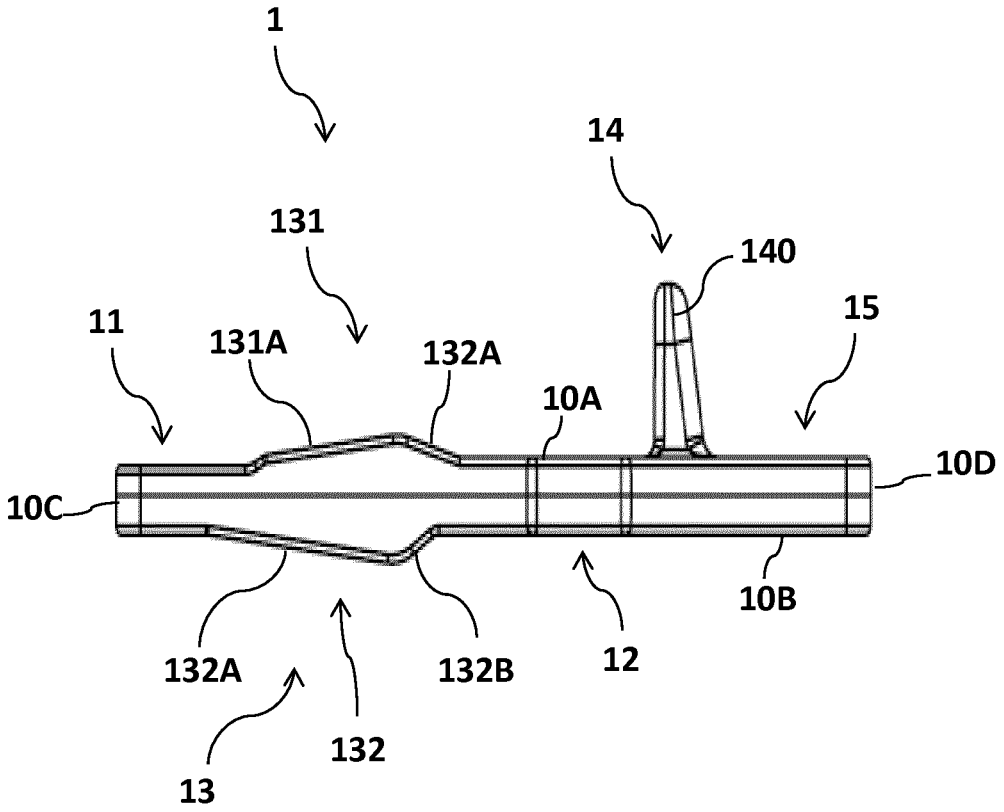
Figure 9:
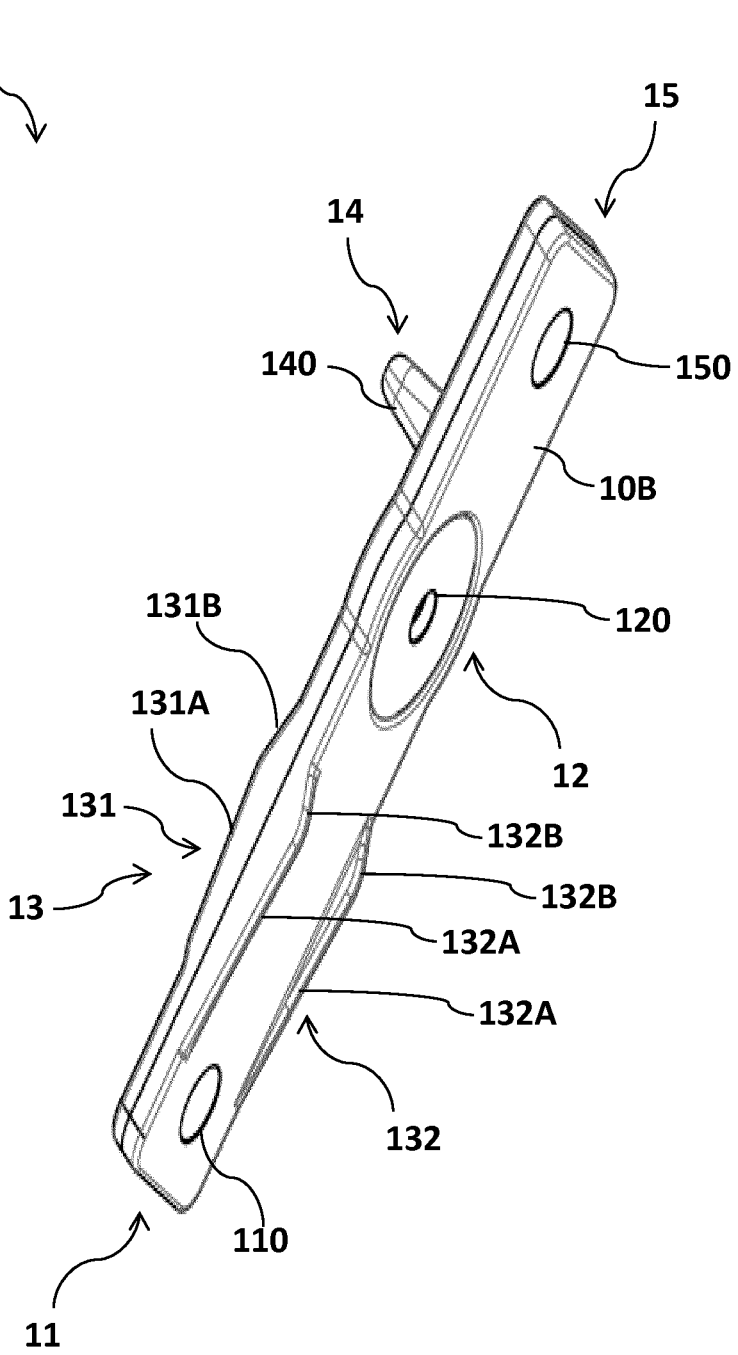

In the embodiment shown in FIGS. 7-9, the shaped through hole 120 is adapted to accommodate suitable fixing means (e.g. a bolt) for mechanically and electrically connected the current breaking unit 5 to the electric terminal 1, 2.

Figure 10:
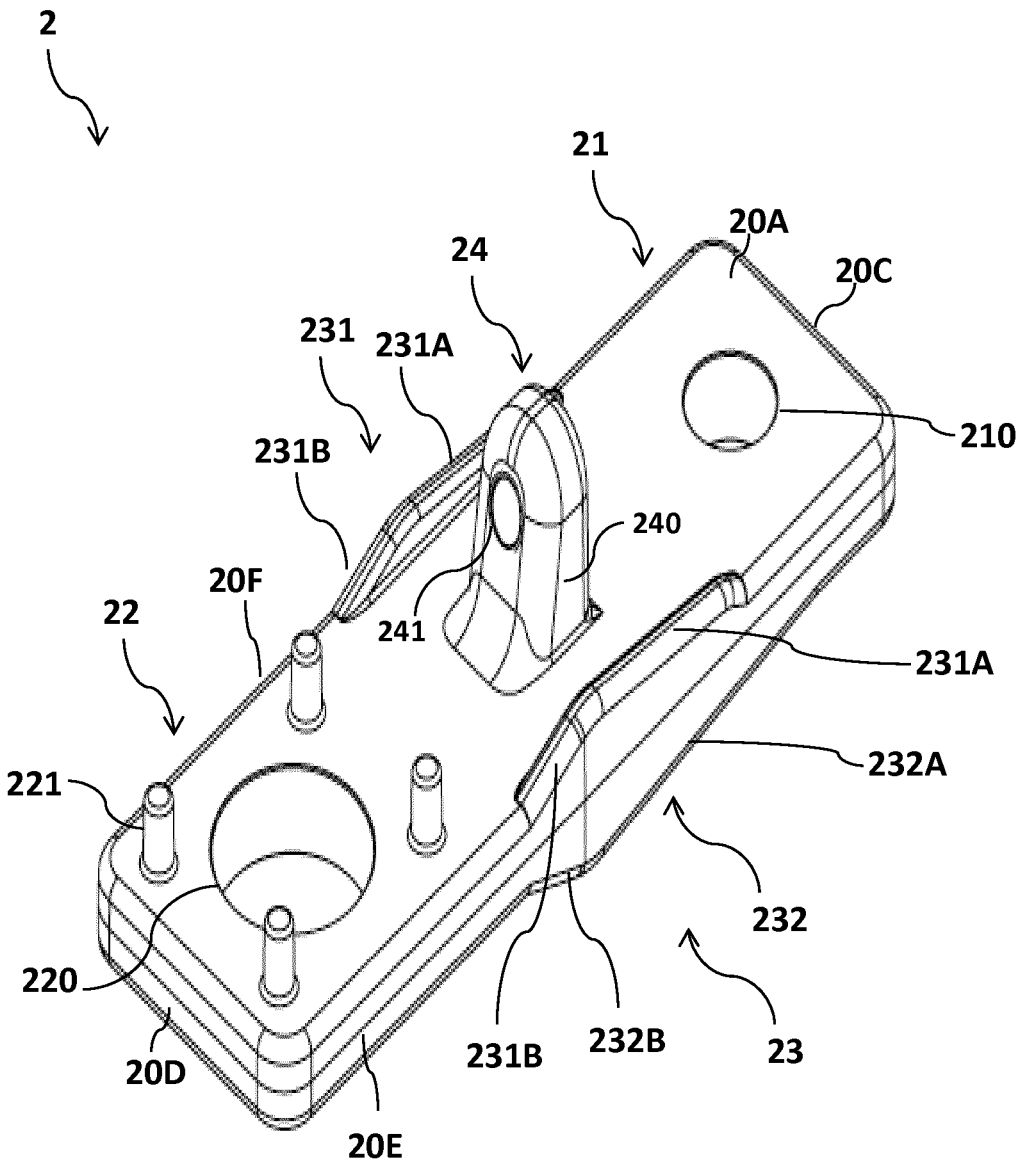
FIG. 10-11 shows schematic views of an electric terminal, according to the invention, in a further embodiment.
Figure 11:
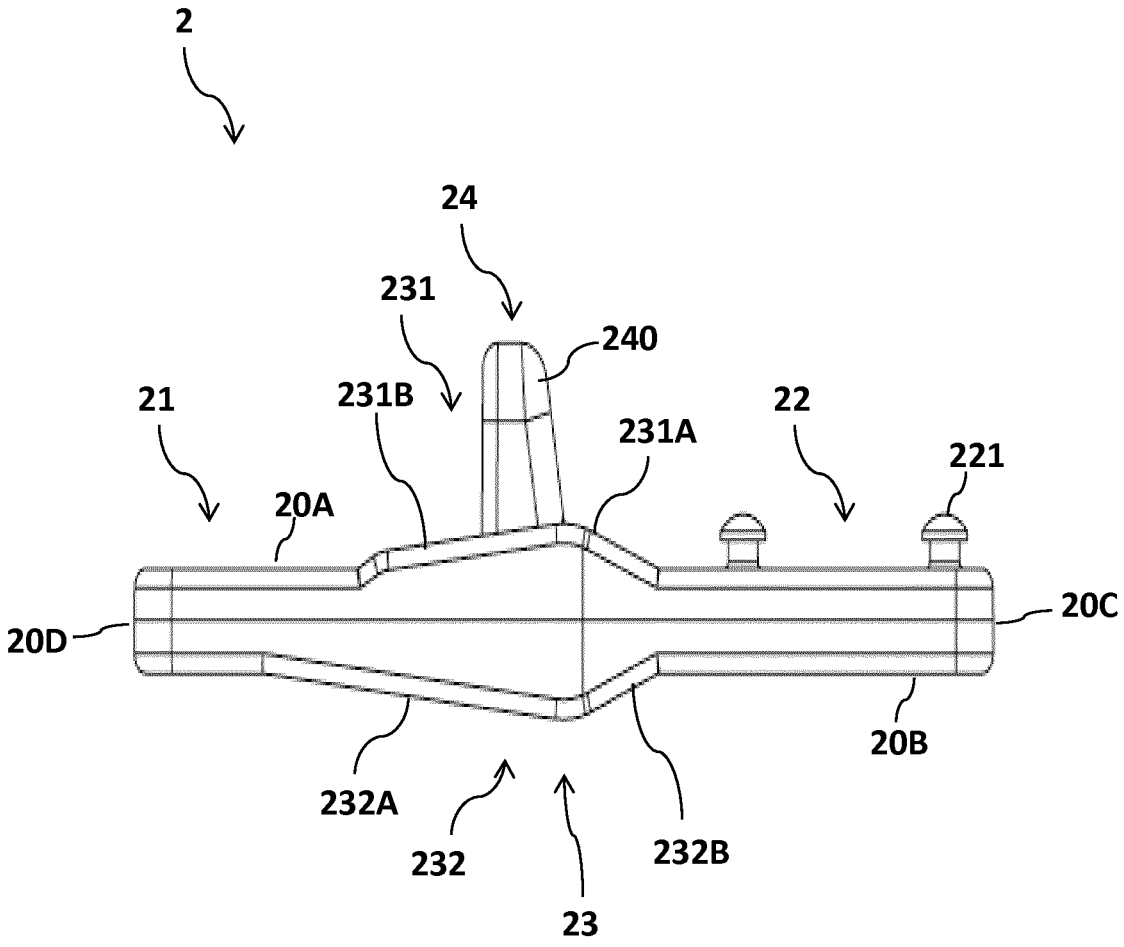

In the embodiment shown in FIGS. 10-11, the shaped through hole 220 is adapted to accommodate a moving part of the current breaking unit 5 (e.g. the moving shaft 521), with which the electric terminal 2 is intended to be in electrical and mechanical sliding coupling.

Preferably, the electric terminal 1, 2 comprises a third portion 13, 23 for mechanical connection with the insulating housing 3 of the electric pole unit 100.

Preferably, the third portion 13, 23 is arranged in an intermediate position between the first and second portions 11, 21, 12, 22 of the electric terminal 1, 2.

Preferably, the third portion 13, 23 comprises the first coupling surfaces 131A, 132A, 231A, 232A of the electric terminal 1, 2 in such a way to be mechanically coupled by friction with the insulating housing 3, when the electric terminal 1, 2 is inserted in the corresponding shaped port 31, 32 of said insulating housing.

Preferably, the third portion 13, 23 of the electric terminal 1, 2 comprises one or more first coupling wings 131, 231, which protrude perpendicularly from the upper surface 10A, 20A of said electric terminal.

Preferably, the third portion 13, 23 comprises a pair of first coupling wings 131, 231, which are mutually spaced and positioned (parallel one to another) at opposite sides 10E, 10F, 20E, 20F of the electric terminal 1, 2.

Preferably, the coupling wings 131, 231 have first wing sections 131A, 231A with a profile tapered (i.e. oriented and inclined) towards the first portion 11, 21 of the electric terminal and which are mating with the profile of corresponding first coupling grooves 311, 321 of the insulating housing.

Preferably, the first coupling grooves 311, 321 of the insulating housing 3 define at least partially the corresponding shaped port 31, 32 of said insulating housing, in which the electric terminal 1, 2 is adapted to be inserted in operation.

Preferably, the first wing sections 131A, 231A abut against the first coupling grooves 311, 321 of the insulating housing 3, when the electric terminal 1, 2 is inserted in the corresponding shaped port 31, 32 of said insulating housing in such a way to obtain a mechanical coupling by friction between the third portion 13 and the insulating housing 3.

Preferably, the third portion 13, 23 of the electric terminal 1, 2 comprises one or more second coupling wings 132, 232, which protrude perpendicularly from the lower surface 10B, 20B of said electric terminal.

Preferably, the third portion 13, 23 comprises a pair of second coupling wings 132, 232, which are mutually spaced and positioned (parallel one to another) at opposite sides 10E, 10F, 20E, 20F of the electric terminal 1, 2.

Preferably, the coupling wings 132, 232 have second wing sections 132A, 232A with a profile tapered (i.e. oriented and inclined) towards the first portion 11, 21 of the electric terminal and mating with the profile of corresponding second coupling grooves 312, 322 of the insulating housing.

Preferably, the second coupling grooves 312, 322 of the insulating housing 3 define at least partially the corresponding shaped port 31, 32 of said insulating housing, in which the electric terminal 1, 2 is adapted to be inserted in operation.

Preferably, the second wing sections 132A, 232A abut against the second coupling grooves 312, 322 of the insulating housing 3, when the electric terminal 1, 2 is inserted in the corresponding shaped port 31, 32 of said insulating housing, in such a way to obtain a mechanical coupling by friction between the third portion 13 and the insulating housing 3.

From the above, it is evident that the first wing sections 131A, 231A of the first coupling wings 131, 231 and/or the second wing sections 132A, 232A of the second coupling wings 132, 232 form the first coupling surfaces of the electric terminal 1, 2 whereas the first coupling grooves 311, 321 and/or the second coupling grooves 312, 322 of the insulating housing 3 form the second coupling surfaces of said insulating housing.

Preferably, the first and second coupling wings 131, 231, 132, 232 have rounded edges.

Preferably, the first and second coupling wings 131, 231 132, 232 are positioned symmetrically with respect to an extension plane of the electric terminal 1, 2.

Preferably, the first coupling wings 131, 231 have third wing sections 131B, 231B with profile tapered towards a direction opposite to the first portion 11, 21 of the electric terminal 1, 2. Conveniently, the third wing sections 131B, 231B are linked up with the first wing sections 131A, 231A.

Preferably, the second coupling wings 132, 232 have fourth wing sections 132B, 232B with profile tapered towards a direction opposite to the first portion 11, 21 of the electric terminal 1, 2. Conveniently, the fourth wing sections 132B, 232B are linked up with the second wing sections 132A, 232A.

Preferably, the electric terminal 1, 2 comprises a fourth portion 14, 24 for mechanical connection with the insulating housing 3.

Preferably, the fourth portion 14, 24 is arranged in such a way to be mechanically coupleable with the insulating housing 3 when the electric terminal 1, 2 is inserted in the corresponding shaped port 31, 32 of said insulating housing.

In the embodiment shown in FIGS. 7-9, the fourth portion 14, is arranged in such a way the second portion 12 is positioned between the third and fourth portions 13, 14 of the electric terminal 1.

In the embodiment shown in FIGS. 10-11, the fourth portion 24, is arranged between the parallel first coupling wings 231 of the third portion 23 of the electric terminal 2.

Preferably, the fourth portion 14, 24 comprises a rounded stud 140, 240, which projects perpendicularly from the upper surface 10A, 20A, of the electric terminal 1, 2.

Preferably, the rounded stud 140, 240 comprises a shaped through hole 141, 241. This latter is preferably oriented substantially parallel to the upper surface 10A, 20A of the electric terminal 1, 2.

When the electric terminal 1, 2 is inserted in the corresponding shaped port 31, 32 of said insulating housing, the rounded stud 140, 240 abuts against the insulating housing 3 and its through hole 141, 241 is aligned with a corresponding shaped through hole 37, 38 of the insulating housing 3 for accommodating suitable fixing means 50 (e.g. a bolt or a screw).

As an alternative, when abutting against the insulating housing 3, the rounded stud 140, 240 may be fixed to the housing 3 by means of different mechanical coupling, such as a snap-fit coupling or a shape coupling.

In the embodiment of FIGS. 10-11, the rounded stud 240 is conveniently at least partially accommodated in a shaped seat 39 of the insulating housing 3, when the electric terminal 2 is inserted in the corresponding shaped port 32 of said insulating housing.

In the embodiment shown in FIGS. 7-9, the electric terminal 1 comprises a fifth portion 15 for electrical connection with an external conductor (not shown) in alternative to the electrical connection at the first portion 11.

Preferably, the fifth portion 15 is arranged in such a way to protrude from the insulating housing 3 at a rear side 3B of this latter (opposite to the front side 3A from which the first portion 11 protrudes), when the electric terminal 1 is inserted in the corresponding shaped port 31, 32 of said insulating housing.

To this aim, the fifth portion 11 is preferably arranged at a second end 10D of the electric terminal 1, opposite to the firs end 10C.

Preferably, the fifth portion 15 comprises a corresponding shaped through hole 150 for accommodating suitable fixing means (e.g. a bolt) for mechanically and electrically connecting the mentioned external conductor to the electric terminal 1.

In a further aspect, the present invention relates to an electric pole unit 100 for a MV switching device, which incorporates one or more electric terminals, according to the invention, arranged as pole terminals of the electric pole unit.

In the cited FIGS. 1-6, it is shown an electric pole unit 100 for a MV switching device, which incorporates a pair of electric terminals, according to the invention, as pole terminals.

The pole unit 100 comprises the insulating housing 3 made of electrically insulating material.

The housing 3 is advantageously formed by an elongated hollow body having a substantially cylindrical shape with a main longitudinal axis A1 (FIG. 1).

With respect to a normal installation position of the pole unit (shown in FIG. 1), the housing 3 comprises a front side 3A, a rear side 3B, a top 3C and a bottom 3D.

Preferably, at its bottom 3B, the housing 3 can be fixed to a support frame of the switching device (not shown) in which the electric pole unit 100 is installed.

The housing 3 defines an internal volume 4 of the electric pole unit, in which the internal components of this latter are accommodated.

At its front side 3A, the insulating housing 3 comprises first and second shaped ports 31, 32 oriented according to axes perpendicular to the main longitudinal axis A1.

At its rear side 3B, the housing 3 is preferably open so as to allow an easy access to the internal volume 4 of the electric pole unit 100.

The pole unit 1 comprises the current breaking unit 5 accommodated within the internal volume 4 of the pole unit.

Conveniently, the breaking unit 5 comprises a fixed contact assembly including at least a fixed contact 51 and moving contact assembly 5 including at least a moving contact 52, which is adapted to be coupled with or separated from the fixed contact assembly, during a switching operation of the switching device including the pole unit 100.

To this aim, the moving contact assembly is adapted to move along the axis A1, during a switching operation of the switching device including the pole unit 100.

Preferably, the breaking unit 5 comprises a vacuum chamber 53, in which the fixed and movable contacts 51, 52 are placed and can be mutually coupled/decoupled.

The mentioned fixed contact assembly, moving contact assembly and vacuum chamber may be of known type and are not described here in more details for the sake of brevity.

The breaking unit 5 may comprise further additional parts of components of known type, which are not described here in details for the sake of brevity.

The electric pole unit 100 comprises first and second pole terminals 1, 2, which are electrically connected to the current breaking unit 5 (respectively at the fixed contact assembly and the moving contact assembly thereof) and are electrically connectable to a first and second external conductors (not shown), respectively.

The first and second pole terminals 1, 2 are inserted in first and second shaped ports 31, 32 of the insulating housing 3.

Each pole terminal 1, 2 of the pole unit 100 is formed by an electric terminal, according to the invention.

In the pole unit 100, the first pole terminal 1, which is positioned in a proximal position with respect to the top 3C of the insulating housing 3C, is formed by the electric terminal of the invention, according to the embodiment shown in FIGS. 7-9.

In general, the pole terminal 1 has one or more first coupling surfaces 131A, 132A mating with one or more second coupling surfaces 311, 312 of the insulating housing 3.

The first coupling surfaces 131A, 132A of the pole terminal 1 abut against the second coupling surfaces 311, 312 of the insulating housing 3 in such a way that the pole terminal 1 is mechanically coupled by friction with the insulating housing 3.

Preferably, the first coupling surfaces 131A, 132A of the electric terminal 1 and the second coupling surfaces 311, 312 of the insulating housing 3 have mating dovetail or conical profiles.

Preferably, the second coupling surfaces 311, 312 of the insulating housing 3 define at least partially the corresponding shaped port 31 of the insulating housing 3, in which the pole terminal 1 is inserted.

Preferably, the pole terminal 1 comprises a first portion 11 for electrical connection with the mentioned external conductor (not shown), which is arranged at a first end 10C of the pole terminal 1.

Preferably, the first portion 11 of the pole terminal 1 protrudes from the insulating housing 3 at a front side 3A of this latter.

Preferably, the first portion 11 of the pole terminal 1 comprises a corresponding shaped through hole 110 for accommodating suitable fixing means (e.g. a bolt) for mechanically and electrically connecting the mentioned first external conductor to the pole terminal 1.

Preferably, the insulating housing 3 comprises a shaped support portion 35 at its front side 3A to provide mechanical support to the first portion 11, as this latter protrudes from said insulating housing.

Preferably, the pole terminal 1 comprises a second portion 12 for electrical connection with the current breaking unit 5 of the electric pole unit 100, more particularly with the fixed contact assembly of this latter.

Preferably, the second portion 12 of the pole terminal 1 is accommodated in the internal volume 4 of the insulating housing 3.

Preferably, the second portion 12 of the pole terminal 1 comprises a corresponding shaped through hole 120 for accommodating suitable fixing means (e.g. a bolt) for mechanically and electrically connected the mentioned fixed contact assembly.

Preferably, the pole terminal 1 comprises a third portion 13 for mechanical connection with the insulating housing 3 of the electric pole unit 100.

Preferably, the third portion 13 of the pole terminal 1 comprises the first coupling surfaces 131A, 132A of the pole terminal 1 in such a way to be mechanically coupled by friction with the insulating housing 3.

Preferably, the third portion 13 of the pole terminal 1 is arranged in an intermediate position between the first and second portions 11, 12 of the pole terminal 1.

Preferably, the third portion 13 of the pole terminal 1 comprises one or more first coupling wings 131 protruding perpendicularly from an upper surface 10A of said pole terminal.

Preferably, the third portion 13 of the pole terminal 1 comprises a pair of first coupling wings 131, which are mutually spaced and positioned (parallel one to another) at opposite sides 10E, 10F of the pole terminal 1.

Preferably, the coupling wings 131 have first wing sections 131A, which are tapered (i.e. oriented and inclined) towards the first portion 11 of the pole terminal and which are mating with corresponding first coupling grooves 311 of the insulating housing 3, which define at least partially the corresponding shaped port 31 of said insulating housing, in which the electric pole 1 is inserted.

Preferably, the first wing sections 131A abut against the first coupling grooves 311 of the insulating housing 3 in such a way that the third portion 13 is mechanically coupled by friction with the insulating housing 3.

Preferably, the third portion 13 of the pole terminal 1 comprises one or more second coupling wings 132, which protrude perpendicularly from a lower surface 10B of said pole terminal.

Preferably, the third portion 13 of the pole terminal 1 comprises a pair of second coupling wings 132, which are mutually spaced and positioned (parallel one to another) at opposite sides 10E, 10F of the electric terminal 1.

Preferably, the coupling wings 132 have second wing sections 132A, which are tapered (i.e. oriented and inclined) towards the first portion 11 of the pole terminal and which are mating with corresponding second coupling grooves 312 of the insulating housing.

Preferably, the second coupling grooves 312 of the insulating housing 3 define at least partially the corresponding shaped port 31 of said insulating housing, in which the electric terminal 1 is inserted.

Preferably, the second wing sections 132A abut against the second coupling grooves 312 of the insulating housing 3 in such a way that the third portion 13 is mechanical coupled by friction with the insulating housing 3.

From the above, it is evident that the first wing sections 131A of the first coupling wings 131 and/or the second wing sections 132A of the second coupling wings 132 of the pole terminal 1 form the first coupling surfaces of the pole terminal 1 whereas the first coupling grooves 311 and/or the second coupling grooves 312 of the insulating housing 3 form the second coupling surfaces of said insulating housing at the first shaped port 31.

Preferably, the first and second coupling wings 131, 231 of the pole terminal 1 have rounded edges.

Preferably, the first and second coupling wings 131, 231 of the pole terminal 1 are positioned symmetrically with respect to an extension plane of the electric terminal 1, 2.

Preferably, the first coupling wings 131 have third wing sections 131B tapered towards a direction opposite to the first portion 11 of the pole terminal 1. Conveniently, the third wing sections 131B are linked up with the first wing sections 131A.

Preferably, the second coupling wings 132 have fourth wing sections 132B tapered towards a direction opposite to the first portion 11 of the pole terminal 1. Conveniently, the fourth wing sections 132B are linked up with the second wing sections 132A.

Preferably, the pole terminal 1 comprises a fourth portion 14 for mechanical connection with the insulating housing 3.

Preferably, the fourth portion 14 of the pole terminal 1 comprises a rounded stud 140, which projects perpendicularly from the upper surface 10A, of the pole terminal 1 and is mechanically coupled with the housing 3.

Preferably, the rounded stud 140 comprises a shaped through hole 141 oriented substantially parallel to the upper surface 10A of the pole terminal 1.

The rounded stud 140 abuts against the insulating housing 3 and its through hole 141 is aligned with a corresponding shaped through hole 37 of the insulating housing 3 for accommodating suitable fixing means 50 (e.g. a bolt or a screw).

As an alternative, the rounded stud 140 may be fixed to the housing 3 by means of different mechanical coupling, such as a snap-fit coupling or a shape coupling.

Preferably, the pole terminal 1 comprises a fifth portion 15 for electrical connection with said first external conductor (not shown) in alternative to the electrical connection at the first portion 11.

Preferably, the fifth portion 15 of the pole terminal 1 protrudes from the insulating housing 3 at the rear side 3B of this latter. To this aim, the fifth portion 11 is preferably arranged at a second end 10D of the pole terminal 1.

Preferably, the fifth portion 15 of the pole terminal 1 comprises a corresponding shaped through hole 150 for accommodating suitable fixing means (e.g. a bolt) for mechanically and electrically connecting the mentioned first external conductor to the electric terminal 1.

In the pole unit 100, the second pole terminal 2, which is positioned in a proximal position with respect to the bottom 3D of the insulating housing 3C, is formed by the electric terminal of the invention, according to the embodiment shown in FIGS. 10-11.

In general, the pole terminal 2 has one or more first coupling surfaces 231A, 232A mating with one or more second coupling surfaces 211, 212 of the insulating housing 3.

The first coupling surfaces 231A, 232A of the pole terminal 2 abut against the second coupling surfaces 321, 322 of the insulating housing 3, in such a way that the pole terminal 2 is mechanically coupled by friction with the insulating housing 3.

Preferably, the first coupling surfaces 231A, 232A of the electric terminal 2 and the second coupling surfaces 321, 322 of the insulating housing 3 have mating dovetail or conical profiles.

Preferably, the second coupling surfaces 321, 322 of the insulating housing 3 define at least partially the corresponding shaped port 32 of the insulating housing 3, in which the pole terminal 2 is inserted.

Preferably, the pole terminal 2 comprises a first portion 21 for electrical connection with the mentioned second external conductor (not shown), which is preferably arranged at a first end 20C of the pole terminal 2.

Preferably, the first portion 21 of the pole terminal 2 protrudes from the insulating housing 3 at a front side 3A of this latter.

Preferably, the first portion 21 of the pole terminal 2 comprises a corresponding shaped through hole 210 for accommodating suitable fixing means (e.g. a bolt) for mechanically and electrically connecting the mentioned first external conductor to the pole terminal 2.

Preferably, the insulating housing 3 comprises a shaped support portion 36 at its front side 3A to provide mechanical support to the first portion 21, as this latter protrudes from said insulating housing.

Preferably, the pole terminal 2 comprises a second portion 22 for electrical connection with the current breaking unit 5 of the electric pole unit 100, more particularly with the moving contact assembly of this latter.

Preferably, the second portion 22 of the pole terminal 2 is accommodated in the internal volume 4 of the insulating housing 3.

Preferably, the second portion 22 of the pole terminal 2 comprises a corresponding shaped through hole 220 for accommodating a moving part 521 of the moving contact assembly of the current breaking unit 5, with which the pole terminal 2 is intended to be in electrical and mechanical sliding coupling.

Preferably, the second portion 22 of the pole terminal 2 comprises connection pins 221 that protrudes from the upper surface 20A for mechanical connection with a fixed part 522 of the moving contact assembly of the current breaking unit 5.

Preferably, the pole terminal 2 comprises a third portion 23 for mechanical connection with the insulating housing 3 of the electric pole unit 100.

Preferably, the third portion 23 comprises the first coupling surfaces 231A, 232A of the pole terminal 2 in such a way to be mechanically coupled by friction with the insulating housing 3.

Preferably, the third portion 23 of the pole terminal 2 is arranged in an intermediate position between the first and second portions 21, 22 of the pole terminal 2.

Preferably, the third portion 23 of the pole terminal 2 comprises one or more first coupling wings 231 protruding perpendicularly from an upper surface 20A of said pole terminal.

Preferably, the third portion 23 of the pole terminal 2 comprises a pair of first coupling wings 231, which are mutually spaced and positioned (parallel one to another) at opposite sides 20E, 20F of the pole terminal 2.

Preferably, the coupling wings 231 have first wing sections 231A, which are tapered (i.e. oriented and inclined) towards the first portion 21 of the pole terminal and which are mating with corresponding first coupling grooves 321 of the insulating housing 3, which define at least partially the corresponding shaped port 31 of said insulating housing, in which the pole terminal 2 is inserted.

Preferably, the first wing sections 231A abut against the first coupling grooves 321 of the insulating housing 3 in such a way that the third portion 23 is mechanically coupled by friction with the insulating housing 3.

Preferably, the third portion 23 of the pole terminal 2 comprises one or more second coupling wings 232, which protrude perpendicularly from a lower surface 20B of said pole terminal.

Preferably, the third portion 23 of the pole terminal 2 comprises a pair of second coupling wings 232, which are mutually spaced and positioned (parallel one to another) at opposite sides 20E, 20F of the pole terminal 2.

Preferably, the coupling wings 232 have second wing sections 232A, which are tapered (i.e. oriented and inclined) towards the first portion 21 of the pole terminal and which are mating with corresponding second coupling grooves 322 of the insulating housing.

Preferably, the second coupling grooves 322 of the insulating housing 3 define at least partially the corresponding shaped port 32 of said insulating housing, in which the pole terminal 2 is inserted.

Preferably, the second wing sections 232A abut against the second coupling grooves 322 of the insulating housing 3 in such a way that the third portion 23 is mechanical coupled by friction with the insulating housing 3.

From the above, it is evident that the first wing sections 231A of the first coupling wings 231 and/or the second wing sections 232A of the second coupling wings 232 form the first coupling surfaces of the pole terminal 2 whereas the first coupling grooves 321 and/or the second coupling grooves 322 of the insulating housing 3 form the second coupling surfaces of said insulating housing at the shaped port 32.

Preferably, the first and second coupling wings 231, 232 of the pole terminal 2 have rounded edges.

Preferably, the first and second coupling wings 231, 232 of the pole terminal 2 are positioned symmetrically with respect to an extension plane of the electric terminal 2.

Preferably, the first coupling wings 231 have third wing sections 231B tapered towards a direction opposite to the first portion 21 of the pole terminal 2. Conveniently, the third wing sections 231B are linked up with the first wing sections 231A.

Preferably, the second coupling wings 232 have fourth wing sections 232B tapered towards a direction opposite to the first portion 21 of the pole terminal 2. Conveniently, the fourth wing sections 232B are linked up with the second wing sections 232A.

Preferably, the pole terminal 2 comprises a fourth portion 24 for mechanical connection with the insulating housing 3.

Preferably, the fourth portion 24 of the pole terminal 2 comprises a rounded stud 240, which projects perpendicularly from the upper surface 20A, of the pole terminal 2 and is mechanically coupled with the housing 3.

Preferably, the rounded stud 240 comprises a shaped through hole 241 oriented substantially parallel to the upper surface 20A of the pole terminal 1.

The rounded stud 240 abuts against the insulating housing 3 and its through hole 241 is aligned with a corresponding shaped through hole 38 of the insulating housing 3 for accommodating suitable fixing means 50 (e.g. a bolt or a screw).

As an alternative, the rounded stud 240 may be fixed to the housing 3 by means of different mechanical coupling, such as a snap-fit coupling or a shape coupling.

To favour its abutment against the insulating housing 3, the rounded stud 240 is at least partially accommodated in a shaped seat 39 of said insulating housing.

The adoption of the electric terminal 1, 2 of the invention as pole terminal in an electric pole unit 100 provides relevant advantages with respect to the currently available solutions.

The electric terminal 1, 2 of the invention allows remarkably reducing the number of fasteners for assembling the electric pole unit 100.

As an example, each pole terminal 1, 2 of the electric pole unit 100 may be fixed to the insulating housing 3 with a single fastener at most.

As a further example, each pole unit 100 incorporating a pair of electric terminals 1, 2 of the invention as pole terminals comprises at least four fasteners in less than traditional electric pole units.

The electric terminal 1, 2 of the invention allows simplifying the assembly of the pole unit.

The electric terminals 1, 2 of the invention can in fact be easily fixed to the current breaking unit 5 before installing this latter in the pole unit 100. The assembly so obtained can then be fixed to the insulating housing 3 according to a plug-in installation mode.

The electric terminal 1, 2 of the invention ensure a higher dielectric strength of the pole unit 100 as the overall number of screws or fasteners is reduced.

The electric terminal 1, 2 of the invention ensure a higher dielectric strength of the pole unit 100 as the overall number of fixing points for screws or fasteners is reduced.

In view of the above, it is evident that the electric terminal 1, 2 of the invention allows fully exploiting the advantages in terms of manufacturing cost reduction, which derive from the adoption of assembled pole units, at the same time remarkably mitigating the disadvantages that can be found in the currently available solutions of this type.

The electric terminal 1, 2 of the invention is easy to manufacture at industrial level by means of standard metallurgical processes.

The invention claimed is:

1. An electric terminal for an electric pole unit of a switching device, said electric terminal being adapted to be electrically connected to a current breaking unit of said electric pole unit and to an external conductor and being adapted to be inserted in a corresponding shaped port of an insulating housing of said electric pole unit, said electrical terminal comprises:

one or more first coupling surfaces mating with one or more second coupling surfaces of said insulating housing, said first coupling surfaces abutting against said second coupling surfaces when said electric terminal is inserted in the corresponding shaped port of said insulating housing in such a way to obtain a mechanical coupling by friction between said electric terminal and said insulating housing;

a first portion for electrical connection with said external conductor, said first portion being arranged in such a way to protrude from said insulating housing, when said electric terminal is inserted in the corresponding shaped port of said insulating housing;

a second portion for electrical connection with said current breaking unit, said second portion being arranged in such a way to be accommodated in an internal volume defined by said insulating housing, when said electric terminal is inserted in the corresponding shaped port of said insulating housing;

a third portion for mechanical connection with said insulating housing, said third portion comprising said first coupling surfaces so that said third portion is mechanically coupled by friction with said insulating housing, when said electric terminal is inserted in the corresponding shaped port of said insulating housing.

2. The electric terminal, according to claim 1, wherein said first coupling surfaces and said second coupling surfaces have mating dovetail or conical profiles.

3. The electric terminal, according to claim 1, wherein said third portion comprises one or more first coupling wings protruding perpendicularly from an upper surface of said electric terminal, said first coupling wings having first wing sections tapered towards the first portion of said electric terminal and mating with first coupling grooves of said insulating housing, said first coupling wings abutting against said first coupling grooves when said electric terminal is inserted in the corresponding shaped port of said insulating housing.

4. The electric terminal, according to claim 3, wherein said first coupling wings have third wing sections tapered towards a direction opposite to the first portion of said electric terminal, said third wing sections being linked up with said first wing sections.

5. The electric terminal, according to claim 3, wherein said first coupling wings have third wing sections tapered towards a direction opposite to the first portion of said electric terminal, said third wing sections being linked up with said first wing sections.

6. The electric terminal, according to claim 1, wherein said third portion comprises one or more second coupling wings protruding perpendicularly from a lower surface of said electric terminal, said second coupling wings having second wing sections tapered towards the first portion of said electric terminal and mating with second coupling grooves of said insulating housing, said second coupling wings abutting against said second coupling grooves when said electric terminal is inserted in the corresponding shaped port of said insulating housing.

7. The electric terminal, according to claim 6, wherein said second coupling wings have fourth wing sections towards a direction opposite to the first portion of said electric terminal, said fourth wing sections being linked up with said second wing sections.

8. The electric terminal, according to claim 6, wherein said third portion comprises a pair of second coupling wings mutually spaced and positioned at opposite sides of said electric terminal.

9. The electric terminal, according to claim 1, wherein it comprises a fourth portion for mechanical connection with said insulating housing, said fourth portion being arranged in such a way to be mechanically coupleable with said insulating housing, when said electric terminal is inserted in the corresponding shaped port of said insulating housing.

10. The electric terminal, according to claim 1, wherein it comprises a fifth portion for electrical connection with said external conductor, said fifth portion being arranged in such a way to protrude from said insulating housing at an opposite side of said insulating housing with respect to said first portion, when said electric terminal is inserted in the corresponding shaped port of said insulating housing.

11. An electric pole unit for a MV switching device comprising:

an insulating housing comprising a first shaped port and a second shaped port;

a current breaking unit positioned in an internal volume of said electric pole unit;

a first pole terminal electrically connected to said current breaking unit and electrically connectable to a first external conductor, said first pole terminal being inserted in said first shaped port;

a second pole terminal electrically connected to said current breaking unit and electrically connectable to a second external conductor, said second pole terminal being inserted in said second shaped port;

wherein at least one of said first and second pole terminals is an electric terminal, according to claim 1.

12. A MV switching device comprising an electric terminal, according to claim 1, arranged in one or more electric pole units of said switching device.

13. The electric terminal, according to claim 2, wherein said third portion comprises one or more first coupling wings protruding perpendicularly from an upper surface of said electric terminal, said first coupling wings having first wing sections tapered towards the first portion of said electric terminal and mating with first coupling grooves of said insulating housing, said first coupling wings abutting against said first coupling grooves when said electric terminal is inserted in the corresponding shaped port of said insulating housing.

14. The electric terminal, according to claim 13, wherein said first coupling wings have third wing sections tapered towards a direction opposite to the first portion of said electric terminal, said third wing sections being linked up with said first wing sections.

15. The electric terminal, according to claim 13, wherein said first coupling wings have third wing sections tapered towards a direction opposite to the first portion of said electric terminal, said third wing sections being linked up with said first wing sections.

16. The electric terminal, according to claim 2, wherein said third portion comprises one or more second coupling wings protruding perpendicularly from a lower surface of said electric terminal, said second coupling wings having second wing sections tapered towards the first portion of said electric terminal and mating with second coupling grooves of said insulating housing, said second coupling wings abutting against said second coupling grooves when said electric terminal is inserted in the corresponding shaped port of said insulating housing.

17. The electric terminal, according to claim 3, wherein said third portion comprises one or more second coupling wings protruding perpendicularly from a lower surface of said electric terminal, said second coupling wings having second wing sections tapered towards the first portion of said electric terminal and mating with second coupling grooves of said insulating housing, said second coupling wings abutting against said second coupling grooves when said electric terminal is inserted in the corresponding shaped port of said insulating housing.

18. The electric terminal, according to claim 7, wherein said third portion comprises a pair of second coupling wings mutually spaced and positioned at opposite sides of said electric terminal.

19. A MV switching device comprising an electric terminal according to claim 2, arranged in one or more electric pole units of said switching device.

20. A MV switching device comprising an electric terminal according to claim 3, arranged in one or more electric pole units of said switching device.

* * * * *